US005104045A

United States Patent [19]

Kah, Jr.

[11] Patent Number: 5,104,045

[45] Date of Patent: Apr. 14, 1992

[54] SPRINKLER NOZZLE FOR UNIFORM PRECIPITATION PATTERNS

[76] Inventor: Carl L. C. Kah, Jr., 778 Lakeside Dr., North Palm Beach, Fla. 33408

[21] Appl. No.: 529,199

[22] Filed: May 25, 1990

Related U.S. Application Data

[60] Continuation-in-part of Ser. No. 403,758, Sep. 6, 1989, which is a division of Ser. No. 37,704, Apr. 13, 1987, Pat. No. 4,867,378.

[51] Int. Cl.[5] ..... B05B 1/26; B05B 3/04

[52] U.S. Cl. ..... 239/246; 239/543

[58] Field of Search ..... 239/543-545, 239/225.1, 233, 246

[56] References Cited

U.S. PATENT DOCUMENTS

| | | | |
|---|---|---|---|
| 1,804,001 | 5/1931 | Eck | 239/DIG. 1 X |
| 2,086,515 | 7/1937 | Evans | 239/246 |
| 3,934,820 | 1/1976 | Phaup | 239/246 X |

FOREIGN PATENT DOCUMENTS

| | | | |
|---|---|---|---|
| 962937 | 3/1948 | France | 239/544 |

*Primary Examiner*—Andres Kashnikow
*Assistant Examiner*—Kevin Weldon
*Attorney, Agent, or Firm*—Jack N. McCarthy

[57] ABSTRACT

A sprinkler nozzle has a plurality of flow passages for forming a desired precipitation pattern between the nozzle and its full range. A conventional nozzle flow passage is used for long range coverage with other secondary flow passages used to provide for close-in droplet coverage. Some passages have a staggered flow wherein water flow is directed through large angle turns for close-in fall-out; secondary passages are also directed to impinge one stream at an angle into a second stream; and secondary passages are also directed onto a concave curved arcuate, or cylindrical, surface to splash outwardly and be deflected along the surface and exit at different angles for a distribution of droplet fall-out.

22 Claims, 1 Drawing Sheet

Fig. 1
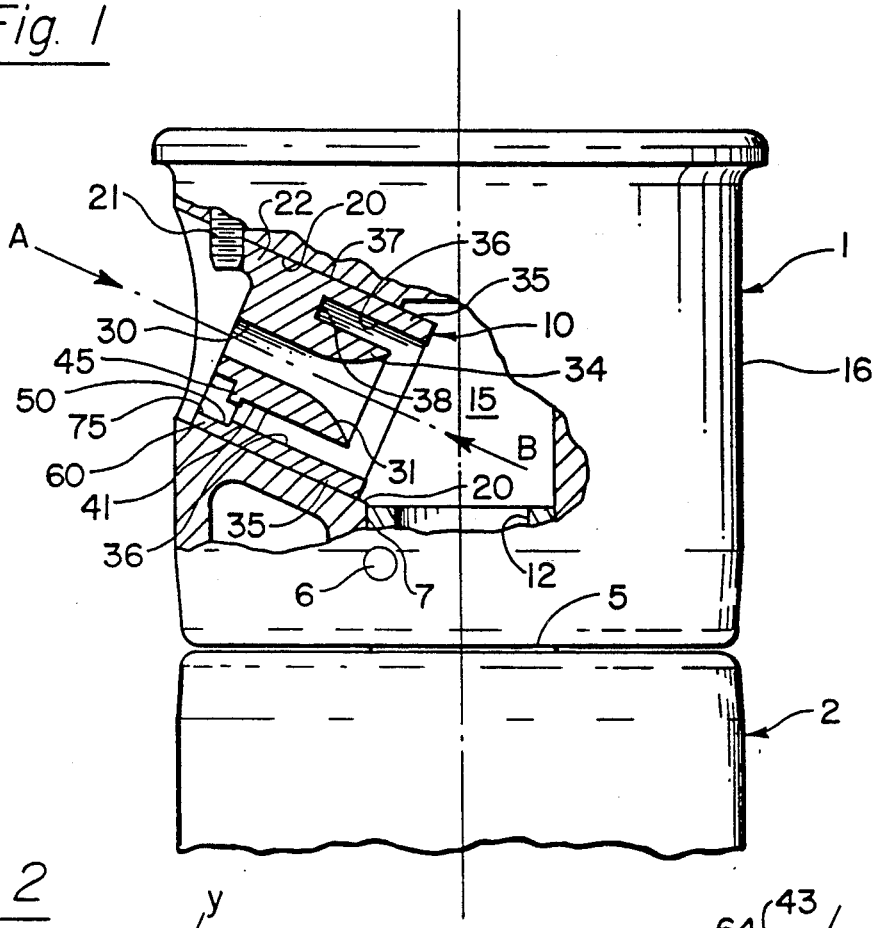
Fig. 2
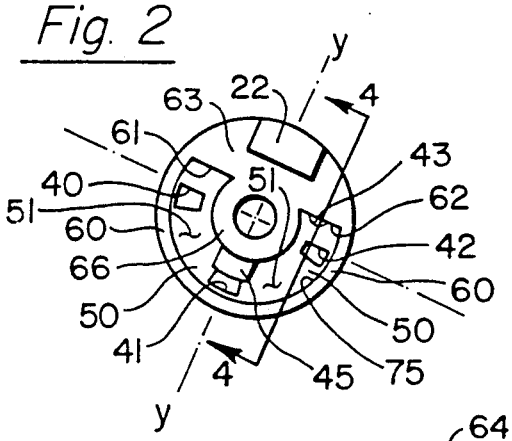
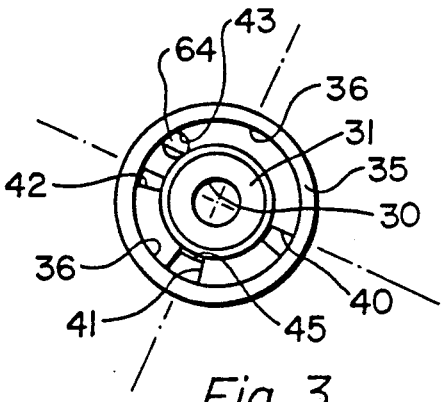
Fig. 3
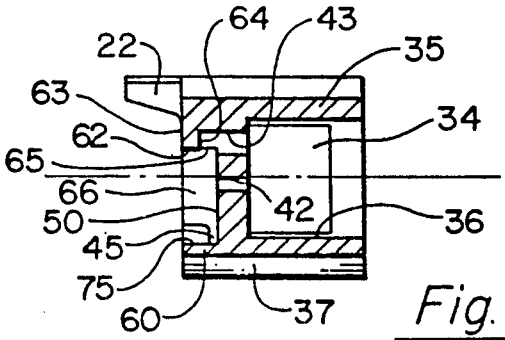
Fig. 4

SPRINKLER NOZZLE FOR UNIFORM PRECIPITATION PATTERNS

RELATIONSHIP TO OTHER CASES

This application is a continuation-in-part of application Ser. No. 403,758, filed Sept. 6, 1989, which is a division of application Ser. No. 034,704, filed Apr. 13, 1987, now U.S. Pat. No. 4,867,378, issued Sept. 19, 1989.

TECHNICAL FIELD

This invention relates to sprinkler nozzles having flow passages for obtaining desired precipitation coverage.

BACKGROUND ART

In the past, efforts were concentrated on getting the nozzle flow stream to reach as far out as possible for the pressure available. For the close-in coverage, smaller secondary nozzles or slots were provided with sharp corner passages as well as the use of a break-up screw which could be adjusted into the main stream to provide the near field spray pattern desired. This approach, however, caused significant reduction in range and its adjustment was subjective on the part of the person doing the adjustment.

Sharp cornered, small passages provide reduced range precipitation but have relied primarily on fogging at the edges to provide coverage closer than six to twelve feet at pressures of greater than 30–40 PSI.

With the advent of computer, finite element analysis of the precipitation fall out from data provided from catch cups placed on the ground in a sprinkler's pattern, it has become obvious of the importance of being able to achieve a particular precipitation pattern relative to a particular placement of other sprinklers and the effects of interacting patterns between sprinklers. Computer modeling shows the importance of being able to provide uniform close-in precipitation from a sprinkler without producing driving sprays against the ground or fogging which is more easily blown away by the wind from the intended fallout area.

Computer modeling of some sprinkler spacing patterns require the precipitation rate (inches/hour/square foot) to be a maximum at the sprinkler and to decrease uniformly out to its maximum range of coverage which is still desired to be as great (far out) as possible for the water pressure that is available. Often pressure of greater than 30 PSI is required for some of the existing nozzles to provide sufficient stream turbulence for even marginal close in coverage and there are many complaints of dry donut-shaped areas close in around the sprinklers.

Additional parts or nozzles and required adjustments or assembly increase the cost of manufacture of the sprinkler and if it relies on someone to make adjustments, it does not provide the inherent uniformity of a single piece nozzle that has multiple features to provide the desired precipitation pattern.

. In my U.S. Pat. No. 4,867,378, issued Sept. 19, 1989 and divisional patent application Ser. No. 403,758, filed Sept. 6, 1989, I disclose a single piece nozzle with a staggered secondary nozzle passage for providing close-in coverage with great ease and precision of manufacture. In my patent application Ser. No. 516,362, filed Apr. 30, 1990, I disclose and claim a sprinkler having a nozzle with secondary flows which impinge on each other.

DISCLOSURE OF INVENTION

A unique simple and easily manufactured one piece nozzle is disclosed which achieves the maximum range capability in air at the water pressure available yet also provides a positive secondary nozzle passage feature which can be used to produce the greater than previous thought desirable, precipitation close-in to the sprinkler.

This invention discloses improvements over the nozzle disclosed in U.S. Pat. No. 4,867,378, and claimed in patent application Ser. No. 403,758 by impinging secondary streams or spray fans to achieve larger low velocity droplets precipitation close-in to the sprinkler. Also, the multiple range precipitation fall out is produced by impinging staggered passage flow against the inside surface of a cylindrically shaped splash surface.

The long range precipitation is provided by a main stream nozzle with a smooth convergent entry. The intermediate range precipitation can easily be provided by smaller sharp cornered holes with hard to produce close-in large drop precipitation being produced by impinging small streams.

One small stream is directed downwardly by its staggered flow from a passage to collide with another secondary flow stream that can be directed out in the direction of the main nozzle flow. The size and shape of each of these colliding streams provide a resultant stream angle and range to be reached by the secondary spray. Many droplets of the resulting spray will fall-out close-in to the sprinkler due to a cancellation of water droplet velocities after colliding or if the streams are directed to partially miss each other so that the perpendicular stream is smaller and merely shears the side off of the axially directed stream.

The nozzle can also be configured such that each of the impinging secondary streams is directed transverse to the axis of the main nozzle and directed to collide head-on with each other to produce precipitation fall-out with much of the resulting water droplet velocities being cancelled causing the droplets to fall-out close-in to the sprinkler.

The staggered flow passage design allows the nozzle to be fabricated as a single piece with straight pull cores and simple tooling for low cost high production.

The downwardly directed staggered flow to the side of the primary nozzle may be used by itself without having its stream collide on another secondary flow stream or a splash plate to provide close-in precipitation. The fall-out pattern range from this secondary staggered flow may be adjusted by the portion of the passage that is left uncovered at the front end of the nozzle.

An object of the invention is to provide an easily manufactured single piece sprinkler nozzle which provides good droplet fall-out close-in and throughout the precipitation pattern to the full range of the nozzle.

A further object of this invention is to provide a sprinkler nozzle having a plurality of flow passageways where there is a conventional nozzle flow passage for far field coverage and a second staggered flow passageway where water flow is directed to strike a third stream of water to provide stream break-up for close-in large droplet coverage.

Another object of this invention is to provide a sprinkler nozzle having two or more flow passages there through; a center conventional nozzle flow passage for far out coverage and one or more staggered passages where water flow is directed through large angle turns, said flow being blocked and forced to turn and impact on a surface and then turn and be impacted by a third passage flow, these two secondary flows being directed to impact on each other thereby eliminating much nozzle axial velocity for these streams before splashing out of the nozzle to fall-out in large droplets close-in to the nozzle even though they are supplied with full sprinkler nozzle pressure on the passages.

A further object of the invention is to provide a sprinkler nozzle having three or more passages there through, a first conventional nozzle passage for the far field coverage, a second nozzle flow passage where flow is directed to be turned through a large angle by a staggered passage, the stagger being created by staggered straight-pull mold cores which shut off on each other to create an opening at right angle to the mold open axis and the axis of the primary straight nozzle. A third passage is created by straight shut off of mold cores with the secondary flow which has been turned at right angle to the primary axis of the nozzle directed to collide off center to provide a shearing stream action against another axial secondary flow to provide for large droplet fall-out near field and further out in range.

Still another objective of the invention is to teach using a staggered passage created by straight pulling shut off cores in a mold to create a single piece configuration of nozzle that turns secondary nozzle flow through an angle sufficient to cause it to splash against an arcuate splash surface and be deflected straight out across arcuate splash surface providing a distribution of spray far out as the spray exits and also be deflected up the sides of the arcuate splash surface to spray outwardly at different locations and directions as the spray moves progressively up the sides of the arcuate splash surface. This action provides a distribution of precipitation at different distances from the sprinkler. Fall-out patterns are easily adjusted with refinement of cavity corners and back wall shape and depth.

BRIEF DESCRIPTION OF DRAWINGS

FIG. 1 is a side fragmentary view of the rotating sprinkler nozzle housing assembly and top of the riser member partly in section showing a one-piece multi-passaged nozzle;

FIG. 2 is a front view looking in the direction of Arrow A of FIG. 1 showing the position and alignment of the nozzle passages and secondary spray cavity;

FIG. 3 is a back view of the one-piece nozzle looking in the direction of Arrow B of FIG. 1 showing the cylindrical secondary flow inlet passage around a center cylindrical area which encloses the convergent portion of the centrally located primary nozzle, the secondary nozzle flow passages can also be seen; and FIG. 4 is a cross sectional view of the nozzle along line 4—4 of FIG. 2 showing the right angle passage which produces approximately a 90 degrees turning of its secondary nozzle flow to impinge on the axial flow from another small secondary passage.

BEST MODE FOR CARRYING OUT THE INVENTION

Referring to FIG. 1 of the drawings, a rotating nozzle sprinkler housing is shown having a cylindrical nozzle housing assembly 1 mounted for rotation about axis X—X on the top of a riser assembly 2. The riser assembly has a center shaft opening at its upper end for the nozzle assembly drive shaft 5 to exit the riser assembly 2 and be connected to the nozzle housing assembly 1 by pin, or set screw, 6 acting on drive shaft 5 which has been fitted into hole 7 on the bottom side of the nozzle housing 16.

The nozzle drive shaft 5 is hollow and water is supplied to the nozzle housing 16 through the passage 12 of the nozzle drive shaft 5 into a cavity 15 in the nozzle housing 16. Water enters the riser assembly 2 at its lower end and is used to power a rotary drive mechanism for turning the nozzle drive shaft 5 before exiting the riser assembly through hole 12 of the nozzle drive shaft. The nozzle housing 16 has a cylindrical bore 20 extending from an inside cavity 15 to the outside of the nozzle housing at an upward angle of 25–27 degrees. A nozzle 10 is sized to have a cylindrical outer surface 37 to fit the cylindrical bore 20 of the nozzle housing 16. The nozzle 10 is retained in its proper position in the cylindrical bore 20 of the nozzle housing 16 by nozzle retention screw 21 extending from the top of the nozzle housing 16 for acting against a rib, or projection, 22 which extends from the top portion of the front face 63 of the nozzle 10 for this purpose. Rib, or projection, 22 is aligned with said nozzle retention screw 21; this properly positions secondary passages to be hereinafter described. The water pressure in cavity 15 of nozzle housing 16 is provided to the back side of nozzle 10 to be directed by primary and secondary passages of the nozzle 10 to provide the desired precipitation pattern over the area covered by the sprinkler.

The nozzle 10 is formed with a center conventional primary flow passage 30 designed to provide a turbulence free coherent stream of water in order to provide a maximum range of coverage for the water pressure available. The primary nozzle passage 30 has an upstream convergent area 31 in an inner cylindrical member 34 of the nozzle 10. A rearwardly extending annular wall 35 extends around cylindrical member 34 and forms a rear annular inlet manifold hole 36 at the rear of nozzle 10 around the primary nozzle convergent area 31 having an annular bottom surface 38.

A discharge front splash cavity 51 is arcuate in shape and extends into the front face 63 of nozzle 10 to a bottom surface 50 axially in line with the bottom portion of the annular bottom surface 38 of annular hole 36. The arcuate discharge front splash cavity 51 ends its arc on each side of the nozzle 10 at end surfaces 61 and 62 in short distance above the center of the nozzle 10; said surfaces 61 and 62 are aligned with each other and act as splash plates to deflect downwardly. Arcuate discharge front splash cavity 51 is wider than annular inlet manifold hold 36 with its inwardly facing arcuate surface 75 located radially outward from the outer surface of annular inlet manifold hole 36 and its outwardly facing arcuate surface located radially inward from the inner surface of annular inlet manifold hole 36.

An arcuate skirt extension 60 is formed between said arcuate discharge front splash cavity 51 and the cylindrical outer surface 37 of nozzle 10. Said arcuate skirt extension 60 has an inwardly facing arcuate surface 75 having a constant radius from the center of the nozzle 10. An arcuate projection 66 is formed between said arcuate discharge front splash cavity 51 and the center of the nozzle 10 around the primary nozzle passage 30. The forward end of the arcuate skirt extension 60 and the forward end of the arcuate projection 66 form the lower portion of the front face 63 of the nozzle 10.

Said surfaces 61 and 62 are located in a plane perpendicular to reference line Y—Y, which extends between the top of the nozzle 10, at the center of rib, or projection, 22 and the center line of the nozzle 10, through the center of primary nozzle passage 30. The surfaces 61 and 62 are shown above the center of the nozzle 10 by approximately 25% of the radius of the nozzle 10. These surfaces can be positioned to obtain the splash effect desired.

To achieve a uniform precipitation fall-out pattern all the way out the stream path when the nozzle is not being turned requires about half of the total flow to be distributed through the secondary nozzle passages. This provides a desired distribution of precipitation when the nozzle is being rotated for overlapping sprinkler installations of sprinklers placed at approximately their radius of coverage.

As shown in FIGS. 2, 3 and 4, secondary nozzle flow passages 40, 41, 42 and 43 are provided in nozzle 10. Each of these passages fundamentally provides precipitation fall-out at different distances from the sprinkler.

As shown in FIGS. 2 and 3, secondary nozzle axial flow passage 40 has a smaller area than primary flow passage 30, and is a sharp cornered passage, connecting the bottom annular surface 38 of annular inlet manifold hole 36 in the rear of nozzle 10 to the bottom surface 50 of the discharge splash cavity 51 in the front of nozzle 10. Secondary nozzle axial flow passage 41 also connects the annular bottom surface 38 of annular inlet manifold hole 36 to the bottom surface 50 of discharge splash cavity 51 but produces à different precipitation fall-out pattern because of the blocking flange 45 extending downwardly over a portion of the discharge at bottom surface 50 forming a partially staggered passage. Secondary nozzle axial flow passage 42 also directly connects the annular bottom surface 38 of annular inlet manifold hole 36 to the bottom surface 50 of arcuate discharge front splash cavity 51 but also produces a different fall-out pattern than the previously discussed secondary passages because of its positioning with another secondary nozzle right angle flow passage 43 which is connected to the annular bottom surface 38 of annular inlet manifold hole 36 and extends past the bottom surface 50 to an end surface 64. Flow passage 43 is connected adjacent end surface 64 through the end surface 62 to the top of bottom surface 50 of arcuate discharge front splash cavity 51 forming an exit opening 65 facing downwardly along the bottom surface 50, said exit opening 65 being located over the inner end of secondary nozzle axial flow passage 42 nearer the center of the nozzle 10. The downward stream from exit 65 of secondary nozzle flow passage 43 impinges and shears the stream leaving the secondary nozzle axial flow passage 42.

The impingement of the secondary right angle stream produced by the nozzle passage 43 with the secondary axial stream exiting passage 42 has been offset toward the center of the nozzle 10 as can be seen by looking at the exit position of passage 43 into the arcuate discharge front splash cavity 51.

The downwardly directed impingement of flow from secondary nozzle right angle flow passage 43 easily shears water droplets from the side of the axial stream exiting from secondary nozzle axial flow passage 42 and provides large droplet fall-out close-in around the sprinkler. Because of the collision of the two streams the axial velocity of some of the resulting droplets has been destroyed and they fall-out close-in at less than the high driving velocities produced by the full pressure applied to the water exiting from the nozzle 10. Secondary nozzle right angle flow passage 43 and its exit opening 65 can be sized and located in conjunction with the size of secondary nozzle axial flow passage 42 to provide the desired resulting impingement precipitation fall-out results as produced by this type of secondary nozzle flow.

The placement of flow from secondary nozzle right angle flow passage 43 exiting from opening 65 in surface 62 is such that some of this flow misses the flow exiting from secondary nozzle axial flow passage 42 and moves straight downwardly to strike the arcuate surface 75 of the arcuate skirt extension 60. Upon striking arcuate surface 75, the flow is deflected around the inside circumference of arcuate surface 75 of arcuate skirt extension 60 in both directions. Some flow deflects upwardly towards the exit of secondary nozzle axial flow passage 42 but primarily it deflects downwardly towards the flow that has exited from secondary nozzle flow passage 41.

The flow exiting from secondary nozzle axial flow passage 41 has been deflected by a short, blocking flange 45 which is positioned over the inner portion of the exit of secondary nozzle axial flow passage 41 at the bottom surface 50 to also strike arcuate surface 75 of the arcuate skirt extension 60 obliquely and is fanned upwardly on each side around the inside of arcuate surface 75. This produces a spray out of the front of arcuate splash cavity 51 of the nozzle 10 at the bottom but also a spray fan extending up each side and exiting out the front at various positions around the inside circumference of arcuate surface 75 of arcuate skirt extension 60.

This in itself produces a variety of precipitation fall-out at various ranges from the sprinkler but the close-in low velocity large droplet fall-out can be enhanced by the collision of the downward splash from the flow from secondary opening 65 which has been directed to miss the secondary stream exiting secondary nozzle axial flow passage 42 as previously described which, after it strikes arcuate surface 75, splashes downwardly along this surface meeting head-on the portion of the splash created by the flow through secondary nozzle axial flow passage 41 having been deflected by blocking flange 45 to also strike arcuate surface 75. This head-on collision effectively cancels axial velocity and produces a splash of large droplets to fall-out close-in to the sprinkler.

The flow from passage 43 can be made to have flows exiting therefrom at varying angles by controlling the extent that the end surface 64 covers the passage 43. This passage 47 can be used without passage 42 or arcuate skirt extension 60.

The one-piece nozzle discussed incorporates the easily manufactured feature which can be tailored for a particular size nozzle to give a precipitation fall-out profile over the stream path area of coverage to provide for very high coefficients of uniformity and scheduling coefficients for either overlapping sprinklers or single sprinkler operation.

While the principles of the invention have now been made clear in an illustrative embodiment, it will become obvious to those skilled in the art that many modifications in arrangement are possible without departing from those principles. The appended claims are, therefore, intended to cover and embrace any such modifications, within the limits of the true spirit and scope of the invention.

I claim:

1. A sprinkler having a rotatable nozzle housing; a nozzle means in said housing for flow therethrough; said nozzle means having a front end and a rear end; a primary nozzle passage extending from said rear end to said front end of said nozzle means to deliver a long range of flow coverage; a recess in said front end of said nozzle means displaced from the primary nozzle passage; said recess having a bottom surface and an inner and outer side surface; a secondary nozzle passage extending from said rear end of said nozzle means to an outlet on said bottom surface of said recess; a blocking surface covering a portion of the outlet on said bottom surface of said recess to form a staggered flow from said outlet; said staggered flow being directed onto said outer side surface of said recess to splash forwardly out of said recess and to each side of the recess.

2. A combination as set forth in claim 1 wherein said secondary nozzle passage outlet has a radial outer edge, said recess outer side surface being stepped radially outwardly from the outer edge of said secondary nozzle passage outlet.

3. A combination as set forth in claim 1 wherein said recess is arcuate, said arcuate recess having an arcuate bottom surface, an arcuate inner and outer side surface, and two end surfaces connecting said inner and outer side surfaces at their ends.

4. A combination as set forth in claim 3 including a second secondary nozzle passage extending from said rear end of said nozzle means to a second outlet on said bottom surface of said arcuate recess; said second outlet being positioned a short distance from one end surface of said arcuate recess; a third secondary nozzle passage extending from said rear end of said nozzle means to a third outlet on said one end surface; said third outlet on said one end surface being directed towards the second outlet for directing a flow from said third outlet onto the flow being directed from said second outlet.

5. A combination as set forth in claim 3 wherein said outlet of said secondary nozzle passage is located at the lowest part of said arcuate bottom surface at a point equidistant from the two end surfaces of said arcuate recess.

6. A combination as set forth in claim 1 wherein an annular inlet manifold opening means is located in said rear end of said nozzle means around said primary nozzle passage; said secondary nozzle passage being connected to the forward end of said annular inlet manifold opening means.

7. A sprinkler having a rotatable nozzle housing; a nozzle means in said housing for flow therethrough; said nozzle means having a front end and a rear end; a primary nozzle passage extending from said rear end to said front end of said nozzle means to deliver a long range of flow coverage; a recess in said front end of said nozzle means displaced from the primary nozzle passage; said recess having a bottom surface and an inner and outer side surface; a first secondary nozzle passage extending from said rear end of said nozzle means to an outlet on said bottom surface of said recess; a blocking surface covering a portion of the outlet on said bottom surface of said recess to form a staggered flow from said outlet; said staggered flow being directed onto said outer side surface of said recess to splash forwardly out of said recess and to each side of the recess, a second secondary nozzle passage extending from said rear end of said nozzle means to a second outlet on said bottom surface of said recess; said second outlet being positioned a short distance from said first secondary nozzle passage, flow being directed from said second secondary nozzle passage to collide with flow from said first secondary nozzle passage.

8. A combination as set forth in claim 3 wherein an annular inlet manifold opening means is located in said rear end of said nozzle means around said primary nozzle passage; said secondary nozzle passage being connected to the forward end of said annular inlet manifold opening means, said arcuate recess being axially aligned with said annular inlet manifold opening means, said annular inlet manifold opening means being narrower in width than said arcuate recess, said outer side surface of said arcuate recess being located outwardly from the outer side of said annular inlet manifold opening means, said secondary nozzle passage being positioned against the outer side of said annular inlet manifold opening means and extending straight through said nozzle to said arcuate recess forming an outlet in the bottom surface thereof, a step being formed between the outlet of said secondary nozzle passage and the outer side surface of said arcuate recess, said staggered flow being directed over said step.

9. A sprinkler having a rotatable nozzle housing; a nozzle means in said housing for flow therethrough; said nozzle means having a front end and a rear end; a primary nozzle passage extending from said rear end to said front end of said nozzle means to deliver a long range of flow coverage; an arcuate recess in said front end of said nozzle means around the lower part of said primary nozzle passage; said arcuate recess having an arcuate bottom surface, two arcuate inner and outer side surfaces, and two end surfaces; a first secondary nozzle passage extending from said rear end of said nozzle means to a first secondary outlet on said bottom surface of said arcuate recess; said first secondary outlet being positioned a short distance from one end surface of said arcuate recess; a second secondary nozzle passage extending from said rear end of said nozzle means to a second secondary outlet on said one end surface; said second secondary outlet on said one end surface being directed towards the first secondary outlet for directing a flow from said second secondary outlet onto the flow being directed from said first secondary outlet.

10. A sprinkler having a rotatable nozzle housing; a nozzle means in said housing for flow therethrough; said nozzle means having a front end and a rear end; a primary nozzle passage extending from said rear end to said front end of said nozzle means to deliver a long range of flow coverage; a secondary nozzle flow impingement surface; a first secondary nozzle passage connecting said rear end of said nozzle means to an outlet on said front end of said nozzle means and configured to direct its flow against said impingement surface; a second secondary nozzle passage extending from said rear end of said nozzle means and configured to also direct its flow against said impingement surface such that a portion of the flow therefrom collides head-on with the flow from said first secondary nozzle passage off of said impingement surface to produce low axial velocity in the direction of the flow from the primary nozzle passage.

11. A sprinkler having a rotatable nozzle housing; a nozzle means in said housing for flow therethrough; said nozzle means having a front end and a rear end; a primary nozzle passage extending from said rear end to said front end of said nozzle means to deliver a long range of flow coverage; an arcuate cylindrical surface on the front end of said nozzle means; a secondary nozzle passage extending from said rear end of said nozzle means to said front end of said nozzle means; said outlet being positioned a short distance from said arcuate cylindrical surface; and flow from said secondary nozzle being directed against said arcuate cylindrical surface such that a circumferential spray pattern is produced that emerges from the arcuate cylindrical surface at a variety of angles to produce a precipitation fall-out at various distances from the nozzle means less than the fall-out from the flow from the primary nozzle passage.

12. A sprinkler having a rotatable nozzle housing; a nozzle means in said housing for flow therethrough; said nozzle means having a front end and a rear end; a primary nozzle passage extending from said rear end to said front end of said nozzle means to deliver a long range of flow coverage; a first secondary nozzle passage extending from said rear end of said nozzle means to a first outlet at the front end of said nozzle means; said outlet being positioned to one side of said primary nozzle passage; a second secondary nozzle passage extending from said rear end of said nozzle means to a second outlet at the front end of said nozzle means; said second outlet being directed towards the first outlet for directing a flow from said second outlet onto the flow being directed from said first outlet.

13. A sprinkler as set forth in claim 12 wherein one of said secondary nozzle passages has a staggered flow therethrough.

14. A rotary drive sprinkler having a nozzle with a front end and a rear end, a first flow passage therethrough from said rear end to said front end of said nozzle, said flow passage having a throat opening for a primary flow, a second flow passage from the rear end to the front end of said nozzle for a first secondary flow, said second flow passage having an exit means configured so that the first secondary flow from this passage exits obliquely to the axis of the primary flow from the first flow passage, a third flow passage from the rear end to said front end for a second secondary flow is provided whose flow exits from the front end of the nozzle directly forwardly, said second secondary flow is impinged on by the first secondary flow which has exited the front of the nozzle obliquely to cause larger quantities of spray droplets to fall-out at predetermined desired distances from the nozzle other than achievable by either flow alone.

15. A combination as set forth in claim 14 wherein said sprinkler has a splash surface, a portion of said first secondary flow does not impinge on said second secondary flow and passes by to strike said splash surface.

16. A rotary drive sprinkler having a nozzle with a front end and a rear end, a first flow passage therethrough from said rear end to said front end of said nozzle, said flow passage having a throat opening for a primary flow, a second flow passage from the rear end to the front end of said nozzle for a secondary flow, said second flow passage having an exit means configured so that the secondary flow from this passage exits oblique to the axis of the primary flow from the first flow passage, wherein the secondary flow is oblique downwardly to strike an arcuate splash surface.

17. A sprinkler having a rotatable nozzle housing; an opening through said nozzle housing directing flow therefrom, a nozzle means in said housing for controlling flow therethrough; said nozzle means having a front end and a rear end; a primary nozzle passage extending from said rear end to said front end of said nozzle means to deliver a long range of flow coverage; a secondary nozzle passage extending from said rear end of said nozzle means to an outlet at the front of said nozzle; a blocking surface covering a portion of the outlet of said secondary nozzle passage to direct flow at an angle therefrom to form a staggered flow from said outlet, an impingement surface spaced from said blocking surface, said flow at an angle being directed onto said impingement surface to complete the staggered flow.

18. A sprinkler having a rotatable nozzle housing; an opening through said nozzle housing directing flow therefrom, a nozzle means in said housing for controlling flow therethrough; said nozzle means having a front end and a rear end; a primary nozzle passage extending from said rear end to said front end of said nozzle means to deliver a long range of flow coverage; a secondary nozzle passage extending from said rear end of said nozzle means to an outlet at the front of said nozzle; a blocking surface forward of a portion of the outlet of said secondary nozzle passage forming an angled flow therefrom; the angled flow forming a fall-out pattern controlled by the size of the portion of the passage left unblocked.

19. A sprinkler having a rotatable nozzle housing; an opening through said nozzle housing directing flow therefrom; a nozzle means in said housing for controlling flow therethrough; said nozzle means having a front end and a rear end; a primary nozzle passage extending from said rear end to said front end of said nozzle means to deliver a long range of flow coverage; a secondary nozzle passage extending from said rear end of said nozzle means to an outlet at the front of said nozzle; a blocking surface forward and above a portion of the outlet of said secondary nozzle passage to be impinged by flow from said secondary nozzle passage; the discharge angle exiting from said outlet of said secondary nozzle passage being controlled by the amount of the outlet of said second nozzle passage blocked.

20. A sprinkler having a rotatable nozzle housing; a nozzle means in said housing for flow therethrough; said nozzle means having a front end and a rear end; a primary nozzle passage extending from said rear end to said front end of said nozzle means to deliver a long range of flow coverage; a recess in said front end of said nozzle means displaced from the primary nozzle passage; said recess having a bottom surface, an inner and outer side surface, and two end surfaces connecting said inner and outer side surfaces at their ends; a first secondary nozzle passage extending from said rear end of said nozzle means to a first outlet on said bottom surface of said recess; said outlet being positioned a short distance from one end surface of said recess; a second secondary nozzle passage extending from said rear end of said nozzle means to a second outlet on said one end surface; said second outlet on said one end surface being directed towards the first outlet on said bottom surface for directing a flow from said second outlet onto the flow being directed from said first outlet.

21. A sprinkler having a rotatable nozzle housing; a nozzle means in said housing for flow therethrough; said nozzle means having a front part and a rear part; a primary nozzle passage extending from said rear part to a first outlet at said front part of said nozzle means to deliver a long range of flow coverage; a secondary nozzle passage extending from said rear part of said nozzle means to a second outlet at the front part of said nozzle means; said outlet being positioned to one side of said first outlet; an arcuate surface on said sprinkler; and flow from said second outlet of said secondary nozzle passage being directed against said arcuate surface such that a circumferential spray pattern is produced that emerges from the arcuate surface at a variety of angles to produce a precipitation fall-out at various distances from the nozzle means less than the fall-out from the primary nozzle passage.

22. A sprinkler having a rotatable nozzle housing; a one-piece nozzle means in said housing for flow therethrough; said nozzle means having a front end and a rear end; a primary nozzle passage extending from said rear end to a primary outlet at said front end of said nozzle means to deliver a long range of flow coverage; a secondary nozzle passage extending from said rear end of said nozzle means to a secondary outlet at said front end of said nozzle means; a flow blocking surface spaced in fron of said secondary outlet; said flow blocking surface being axially in line with an upper portion of said secondary outlet; flow from said secondary outlet impinges on a portion of said blocking surface and is directed at an angle to the flow from said primary outlet.

* * * * *